US012331260B2

(12) United States Patent
Ruhe, Jr. et al.

(10) Patent No.: US 12,331,260 B2
(45) Date of Patent: Jun. 17, 2025

(54) ASHLESS ADDITIVE COMPOSITION

(71) Applicants: CHEVRON ORONITE COMPANY LLC, San Ramon, CA (US); CHEVRON JAPAN LTD., Tokyo (JP)

(72) Inventors: William Raymond Ruhe, Jr., Benicia, CA (US); Masami Fuchi, Makinohara (JP); Seyedeh Mahboobeh Hosseini, Richmond, CA (US)

(73) Assignees: CHEVRON ORONITE COMPANY LLC, San Ramon, CA (US); CHEVRON JAPAN LTD., Tokyo (JP)

( * ) Notice: Subject to any disclaimer, the term of this patent is extended or adjusted under 35 U.S.C. 154(b) by 0 days.

(21) Appl. No.: 17/710,033

(22) Filed: Mar. 31, 2022

(65) Prior Publication Data

US 2022/0220410 A1 Jul. 14, 2022

Related U.S. Application Data

(63) Continuation-in-part of application No. 17/764,608, filed as application No. PCT/IB2021/058896 on Sep. 29, 2021.

(Continued)

(51) Int. Cl.
*C10M 133/40* (2006.01)
*C10M 133/16* (2006.01)

(Continued)

(52) U.S. Cl.
CPC ..... *C10M 133/40* (2013.01); *C10M 133/16* (2013.01); *C10M 169/04* (2013.01);

(Continued)

(58) Field of Classification Search
CPC ..... C10M 133/40; C10M 169/04; C10M 2215/221; C10M 2215/28; C10M 133/16;

(Continued)

(56) References Cited

U.S. PATENT DOCUMENTS 3,200,076 A 8/1965 Anderson
4,839,071 A * 6/1989 Gutierrez ..... C08F 8/28 508/243

(Continued)

FOREIGN PATENT DOCUMENTS

CA 3036236 A1 3/2018
CN 1150971 A 6/1997

(Continued)

OTHER PUBLICATIONS

PCT International Search Report and Written Opinion mailed on Dec. 20, 2021 issued in Application No. PCT/IB2021/058896, filed on Sep. 29, 2021, 11 pages.

(Continued)

*Primary Examiner* — Ellen M McAvoy

(57) ABSTRACT

This disclosure describes an ashless lubricant additive. The additive is a tertiary amine-containing compound having the following structure:

where each $R^1$ and $R^5$ is independently a linear or branched-chain monovalent hydrocarbyl group having two to about twenty carbon atoms, where each $R^2$, $R^3$, and $R^4$ is independently a hydrogen, a linear or branched-chain monovalent hydrocarbyl group having one to about twenty carbon atoms wherein at least one of $R^2$, $R^3$, and $R^4$ is hydrogen, each m is independently from 0 to 2, each p is independently (Continued)

from 0 to 2, for each cylic moiety m+p is from 2 to 4, and each n is independently from 1 to 6.

15 Claims, 2 Drawing Sheets

Related U.S. Application Data

(60) Provisional application No. 63/087,584, filed on Oct. 5, 2020.

(51) Int. Cl.

| | |
|---|---|
| ***C10M 169/04*** | (2006.01) |
| *C10N 30/00* | (2006.01) |
| *C10N 30/06* | (2006.01) |
| *C10N 40/04* | (2006.01) |
| *C10N 40/08* | (2006.01) |
| *C10N 40/25* | (2006.01) |
| *C10N 70/00* | (2006.01) |

(52) U.S. Cl.
CPC ... *C10M 2215/221* (2013.01); *C10M 2215/28* (2013.01); *C10N 2030/06* (2013.01); *C10N 2030/45* (2020.05); *C10N 2030/52* (2020.05); *C10N 2040/042* (2020.05); *C10N 2040/045* (2020.05); *C10N 2040/08* (2013.01); *C10N 2040/25* (2013.01); *C10N 2070/00* (2013.01)

(58) Field of Classification Search
CPC ..... C10M 2215/08; C10M 2215/086; C10N 2030/06; C10N 2030/45; C10N 2030/52; C10N 2040/042; C10N 2040/045; C10N 2040/08; C10N 2040/25
USPC ..... 508/255, 256
See application file for complete search history.

(56) References Cited

U.S. PATENT DOCUMENTS

| | | | | |
|---|---|---|---|---|
| 6,559,106 | B1 * | 5/2003 | Nalesnik | C10M 133/40 508/255 |
| 7,091,306 | B2 | 8/2006 | Heddadj et al. | |
| 8,551,927 | B2 * | 10/2013 | Saccomando | C10M 133/16 508/273 |
| 2006/0160709 | A1 | 7/2006 | Koshima | |
| 2009/0270531 | A1 | 10/2009 | Ruhe, Jr. | |
| 2012/0291737 | A1 | 11/2012 | Mathur | |
| 2015/0232776 | A1 * | 8/2015 | Pierre | C10M 133/08 508/255 |
| 2018/0034635 | A1 | 2/2018 | Zhang et al. | |
| 2019/0249105 | A1 * | 8/2019 | Delbridge | C10M 141/06 |
| 2022/0220410 | A1 * | 7/2022 | Ruhe, Jr. | C10M 133/40 |
| 2023/0287291 | A1 * | 9/2023 | Hattori | C10M 141/08 508/260 |

FOREIGN PATENT DOCUMENTS

| | | | |
|---|---|---|---|
| CN | 102057023 | A | 5/2011 |
| EP | 0451380 | B2 | 7/1997 |
| EP | 1508610 | A1 | 2/2005 |
| EP | 1078977 | B1 | 1/2010 |
| EP | 1642955 | B1 | 1/2016 |
| WO | 2004113477 | A1 | 12/2004 |
| WO | 2022074512 | A1 | 4/2022 |
| WO | 2022074547 | A1 | 4/2022 |

OTHER PUBLICATIONS

PCT International Search Report and Written Opinion mailed on Dec. 23, 2022, issued in International Application No. PCT/US2022/071485, filed on Mar. 31, 2022, 4 pages.

Zagidullin Rn et al: "Development of Procedures for the Manufacture of New Ashless Polymer Additives Derived From Imido Derivatives of Succinic Acid", Chemistry and Technology of Fuels and Oils, Consultants Bureau, U.S., vol. 53, No. 4, Nov. 4, 2017 (Nov. 4, 2017), pages.

* cited by examiner

ASHLESS ADDITIVE COMPOSITION

TECHNICAL FIELD

This disclosure relates to lubricating oil additives and lubricating oil compositions containing the same. More specifically, this disclosure describes ashless additives that can increase total base number and/or modify friction and/or improve wear performance in lubricating oils.

BACKGROUND

Lubricating oils are often formulated to a specific total base number (TBN) or TBN range. This ensures that the lubricating oils contain sufficient basic additives and/or detergents to neutralize acidic byproducts that can damage engine parts. Conventional base-containing additives such as overbased phenate and sulfonate detergents carry with them an abundance of metal as measured by sulfated ash.

This presents challenges as industry and regulatory standards keep pushing towards ash restriction.

Basic amine additives are an alternative to ash containing overbased metal detergents. At least one drawback is that amine additives can degrade fluoroelastomers which are commonly found in seals (e.g., Viton seals). Basic amine additives, such as succinimide dispersants, contain polyamine head-groups, which are believed to cause dehydrofluorination in fluoroelastomeric seals.

Certain additives may be multi-functional (e.g., friction modifier, anti-wear) and provide more than one performance benefit.

Therefore, there is a need for commercially viable ashless additives that are compatible with fluoroelastomeric seals.

SUMMARY

In one aspect, there is provided an ashless additive composition comprising: tertiary amine-containing compound having the following structure:

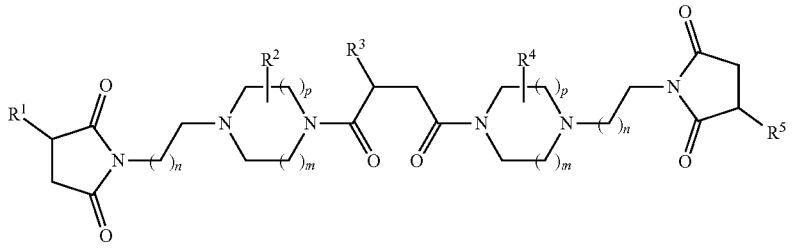

wherein each $R^1$ and $R^5$ is independently a linear or branched-chain monovalent hydrocarbyl group having two to about twenty carbon atoms, wherein each $R^2$, $R^3$, and $R^4$ is independently a hydrogen, a linear or branched-chain monovalent hydrocarbyl group having one to about twenty carbon atoms wherein at least one of $R^2$, $R^3$, and $R^4$ is hydrogen, each m is independently from 0 to 4, each p is independently from 0 to 4, for each cyclic moiety m+p is from 2 to 4, and n is independently from 1 to 6.

In another aspect, there is provided a lubricating oil composition comprising: a major amount of a base oil; and an ashless tertiary amine-containing compound having the following structure:

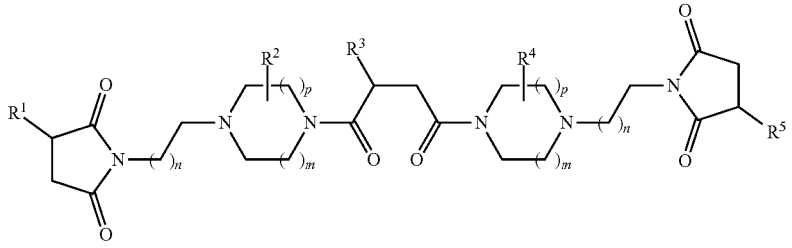

wherein each $R^1$ and $R^5$ is independently a linear or branched-chain monovalent hydrocarbyl group having two to about twenty carbon atoms, wherein each $R^2$, $R^3$, and $R^4$ is independently a hydrogen, a linear or branched-chain monovalent hydrocarbyl group having one to about twenty carbon atoms wherein at least one of $R^2$, $R^3$, and $R^4$ is hydrogen, each m is independently from 0 to 4, each p is independently from 0 to 4, for each cyclic moiety m+p is from 2 to 4, and n is independently from 1 to 6.

In yet another aspect, there is provided an ashless additive composition comprising diamide product of a reaction comprising: a hydrocarbyl-substituted succinic anhydride represented by the following structure:

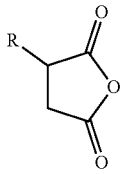

wherein R is a linear or branched-chain monovalent hydrocarbyl group having two to about twenty carbon atoms; and a cyclic polyamine represented by the following structure:

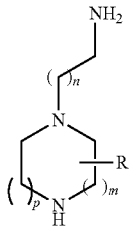

wherein R is a linear or branched-chain monovalent hydrocarbyl group having two to about twenty carbon atoms, m is from 0 to 4, p is from 0 to 4, m+p is from 2 to 4, and n is from 1 to 6; and wherein the hydrocarbyl-substituted succinic anhydride to cyclic polyamine ratio is from about 1.5:1 to about 1.6:1.

In still yet another aspect, there is provided a method for operating an internal combustion engine comprising lubricating said engine with a lubricating oil composition comprising: a major amount of base oil of lubricating viscosity; and an ashless tertiary amine containing composition having the following structure:

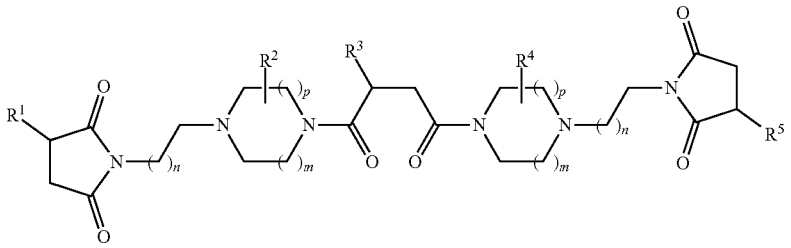

wherein each $R^1$ and $R^5$ is independently a linear or branched-chain monovalent hydrocarbyl group having two to about twenty carbon atoms, wherein each $R^2$, $R^3$, and $R^4$ is independently a hydrogen, a linear or branched-chain monovalent hydrocarbyl group having one to about twenty carbon atoms wherein at least one of $R^2$, $R^3$, and $R^4$ is hydrogen, each m is independently from 0 to 4, each p is independently from 0 to 4, for each cyclic moiety m+p is from 2 to 4, and n is independently from 1 to 6.

DETAILED DESCRIPTION

Definitions

Figure 1:
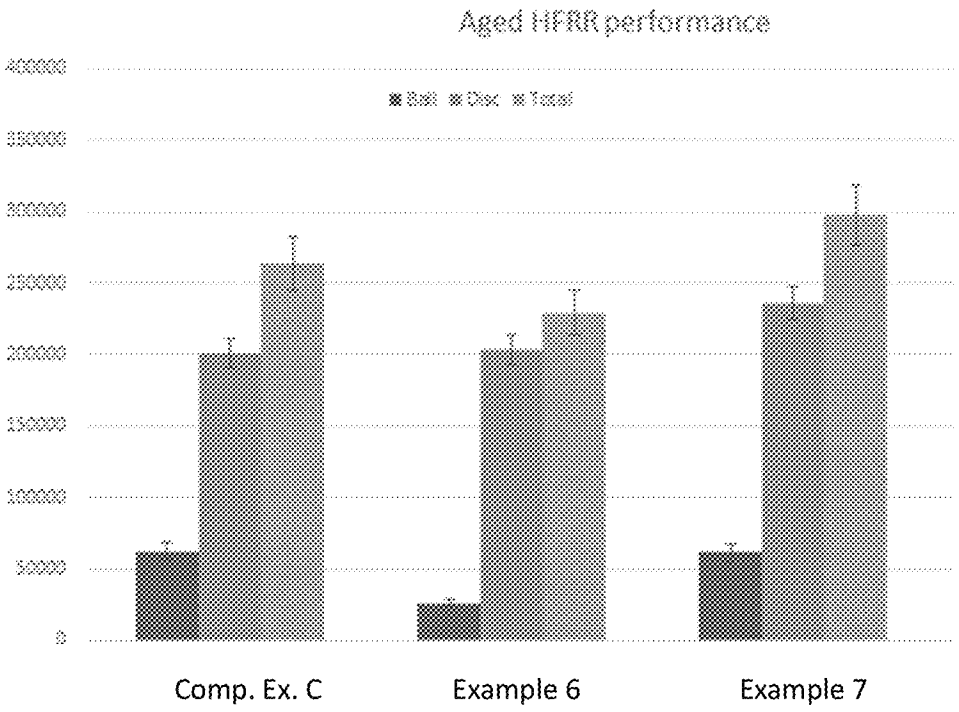
FIG. 1 shows a graph illustrating an aspect of the present invention as described in the Examples.

The term "total base number" or "TBN" refers to the amount of base equivalent to milligrams of KOH in 1 gram of sample as measured by the ASTM D-2896 test.

The term "hydrocarbyl" refers to a chemical group or moiety derived from hydrocarbons including saturated and unsaturated hydrocarbons. Examples of hydrocarbyl groups include alkenyl, alkyl, polyalkenyl, polyalkyl, phenyl, and the like.

The terms 'oil-soluble' or 'oil-dispersible' as used herein do not necessarily indicate that the compounds or additives are soluble, dissolvable, miscible or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein.

The present invention relates to an ashless additive composition that can be utilized as a TBN source and/or friction modifier and/or anti-wear agent in lubricating oil. The additive composition can be used at cost-effective treat rates while maintaining fluoroelastomer seal compatibility. In some embodiments, the present invention may also be used as a friction modifier which reduces friction and wear in machine components. Other advantages will be apparent from the disclosure herein.

The ashless additive composition of the present invention includes product(s) of a reaction involving a hydrocarbyl-substituted succinic anhydride and a cyclic polyamine. The result is a diamide structure featuring at least two basic tertiary amines.

The ashless additive composition of the present invention may be synthesized by any known compatible method such as those described in, for example, U.S. Patent Publication No. 20180034635 and U.S. Pat. No. 7,091,306, which are hereby incorporated by reference.

The reaction may proceed under various conditions. Generally, the hydrocarbyl-substituted succinic anhydride is reacted with the cyclic polyamine at a temperature of about 130° C. to 220° C. (e.g., 140° C. to 200° C., 145° C. to 175° C., etc.). More preferably, the temperature may range from about 160° C. to 215° C. In general, the imidation step may be carried out at lower temperatures (e.g., 150° C. to 170° C.) while higher temperatures (e.g., 200° C. to 220° C.) may be necessary to complete the amidation step.

The reaction can be carried out under an inert atmosphere, such as nitrogen or argon. Generally, a suitable molar charge of hydrocarbyl-substituted succinic anhydride to cyclic polyamine is from about 1.4:1 to about 1.7:1, more preferably from about 1.5:1 to about 1.6:1. In some embodiments, it may be desirable to have a charge mole ratio (CMR) of the hydrocarbyl-substituted succinic anhydride to the cyclic polyamine to be about 1.55:1 or slightly higher in order to react with any unreacted secondary amines. It is believed that secondary amines are more aggressive against seals. The charge mole ratio is important as too much hydrocarbyl-substituted succinic anhydride can result in mono amide/acid structure instead of the diamide structure while too little can result in mono succinimide products containing secondary amines.

In some embodiments, the reaction may proceed in multiple steps, wherein the total CMR of hydrocarbyl-substituted succinic anhydride to cyclic polyamine or cyclic polyamine product is from about 1.4:1 to about 1.7:1, more preferably from about 1.5:1 to about 1.6:1. For example, the first step may involve the reaction between the hydrocarbyl-substituted succinic anhydride and cyclic polyamine in a 1:1 charge mole ratio to generate the imide structure. In the second step, the imide structure is reacted with hydrocarbyl-substituted succinic anhydride at about 0.5 charge mole ratio (succinic anhydride to imide product) to form the diamide structure. The total CMR of the two steps is 1.5:1. The hydrocarbyl-substituted succinic anhydride in the first step and hydrocarbyl-substituted succinic anhydride in the second step may be the same or may differ in the hydrocarbyl groups.

According to an embodiment, the hydrocarbyl-substituted succinic anhydride is given by Structure I:

Structure I

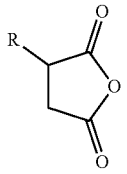

wherein R is a linear or branched-chain monovalent hydrocarbyl group having two to about twenty carbon atoms, such as from ten to twenty carbon atoms, twelve to twenty carbon atoms, and fourteen to twenty carbon atoms. In some embodiments, the average number of carbons is about 14 or higher. R may be cyclic or acylic. In some embodiments, R is saturated. In other embodiments, R is unsaturated.

The exact structure of the hydrocarbyl group may depend on a number of factors. Solubility in oil is an important consideration. In general, longer hydrocarbyl groups have greater solubility in oil.

Hydrocarbyl-substituted succinic anhydrides are commercially readily available. For example, alkenyl succinic anhydrides are widely used in paper sizing. Conversely, hydrocarbyl-substituted succinic anhydrides of the present invention may be synthesized by well-established methods. One conventional synthesis involves reacting maleic anhydride with an olefin at elevated temperatures (~200° C.).

According to an embodiment, the cyclic polyamine is represented by Structure II:

Structure II

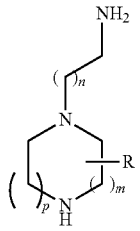

wherein R is a linear or branched-chain monovalent hydrocarbyl group having two to about twenty carbon atoms, m is from 0 to 4, p is from 0 to 4, wherein m+p is from 2 to 4, and n is from 1 to 6. R may be cyclic or acylic. In some embodiments, R is saturated. In other embodiments, R is unsaturated. The cyclic polyamine serves as the source of basic tertiary amines.

Many of the polyamines suitable for use in the present invention are commercially available and others may be prepared by methods which are well known in the art. For example, methods for preparing amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99 116.

Suitable examples of cyclic polyamines include, for example, aminoethyl piperazine, aminopropyl piperazine, aminobutyl piperazine, aminoethyl diazepane, aminoethyl diazocane, suitable derivatives thereof, and the like.

One class of ashless additive composition may be represented by Structure III:

Structure III

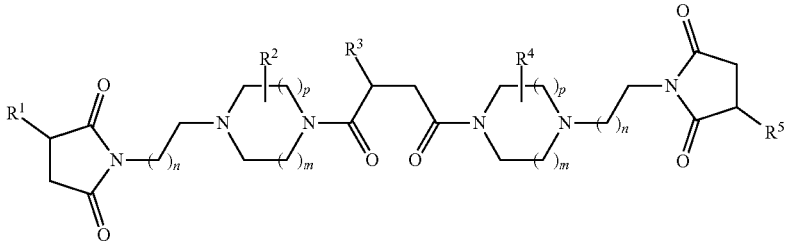

wherein each $R^1$ and $R^5$ is independently a linear or branched-chain monovalent hydrocarbyl group having two to about twenty carbon atoms, wherein each $R^2$, $R^3$, and $R^4$ is independently a hydrogen, a linear or branched-chain monovalent hydrocarbyl group having one to about twenty carbon atoms wherein at least one of $R^2$, $R^3$, and $R^4$ is hydrogen, each m is independently from 0 to 4, each p is independently from 0 to 4, for each cyclic moiety m+p from 2 to 4 and each n is independently from 1 to 6.

Lubricating Oil

When employed as lubricant additives, the ashless additive composition of the present invention is usually present in the lubricating oil composition in concentrations ranging from about 0.001 to about 20 wt. % (including, but not limited to, 0.01 to 5 wt. %, 0.2 to 4 wt. %, 0.5 to 3 wt. %, 1 to 2 wt. %, and so forth), based on the total weight of the lubricating oil composition.

Oils used as the base oil will be selected or blended depending on the desired end use and the additives in the finished oil to give the desired grade of engine oil, e.g. a lubricating oil composition having an Society of Automotive Engineers (SAE) Viscosity Grade of 0W, 0W-8, 0W-16, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this disclosure are the same as those found in American Petroleum Institute (API) Publication 1509 Annex E ("API Base Oil Interchangeability Guidelines for Passenger Car Motor Oils and Diesel Engine Oils," December 2016). Group I base stocks contain less than 90% saturates and/or greater than 0.03% sulfur and have a viscosity index greater than or equal to 80 and less than 120 using the test methods specified in Table E-1. Group II base stocks contain greater than or equal to 90% saturates and less than or equal to 0.03% sulfur and have a viscosity index greater than or equal to 80 and less than 120 using the test methods specified in Table E-1. Group III base stocks contain greater than or equal to 90% saturates and less than or equal to 0.03% sulfur and have a viscosity index greater than or equal to 120 using the test methods specified in Table E-1. Group IV base stocks are polyalphaolefins (PAO). Group V base stocks include all other base stocks not included in Group I, II, III, or IV.

Natural oils include animal oils, vegetable oils (e.g., castor oil and lard oil), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (e.g., polybutylenes, polypropylenes, propylene isobutylene copolymers, ethylene-olefin copolymers, and ethylene-alphaolefin copolymers). Polyalphaolefin (PAO) oil base stocks are commonly used synthetic hydrocarbon oil. By way of example, PAOs derived from $C_8$ to $C_{14}$ olefins, e.g., $C_8$, $C_{10}$, $C_{12}$, $C_{14}$ olefins or mixtures thereof, may be utilized.

Other useful fluids for use as base oils include non-conventional or unconventional base stocks that have been processed, preferably catalytically, or synthesized to provide high performance characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks. Other base oils include Coal to liquid (CTL) products and alkyl-naphthalene.

Base oils for use in the lubricating oil compositions of present disclosure are any of the variety of oils corresponding to API Group I, Group II, Group III, Group IV, and Group V oils, and mixtures thereof, preferably API Group II, Group III, Group IV, and Group V oils, and mixtures thereof, more preferably the Group III to Group V base oils due to their exceptional volatility, stability, viscometric and cleanliness features.

Typically, the base oil will have a kinematic viscosity at 100° C. (ASTM D445) in a range of 1.5 to 35 $mm^2/s$ (e.g., 1.5 to 25 $mm^2/s$, 2.0 to 20 $mm^2/s$, or 2.0 to 15 $mm^2/s$).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt. %, such as about 0.01 to about 10 wt. %.

The following non-limiting examples are illustrative of the present invention. Brief descriptions of how the examples were prepared are provided.

EXAMPLES

Example 1

A 1 L stirred reactor was charged with 550.28 g thermal maleation of 9-methylenenonadecane product (saponification number=257 mgKOH/g). The reactor was heated to 150° C. under a nitrogen sweep. 101.63 g of 1-(2-aminoethyl) piperazine (molecular weight=129.20 g/mole) was charged with thermal maleation of 9-methylenenonadecane product over 45-minute period. The temperature of the mixture was increased to 160° C. and maintained for 2 hours. The reaction was pulled under vacuum up to 20 mm Hg for 30 minutes. The product had the following properties: TBN=80.3 mg KOH/g, nitrogen=5.21 wt %.

Example 2

A 4 L stirred reactor was charged with 1337.1 g of hexadecenyl succinic anhydride (saponification number=352 mg KOH/g) and 338.67 g of 1-(2-aminoethyl) piperazine (molecular weight=129.20 g/mole). The reactor was heated to 195° C. under a nitrogen sweep and maintained for 1 hour. The mixture was then cooled down to ambient temperature.

The reaction mixture was reheated the following day to 200° C. while applying vacuum up to 35 mm Hg. The reaction mixture was held at temperature for an additional 2.5 hours. The product had the following properties: TBN=90.14 mg KOH/g, nitrogen=6.56 wt %.

Example 3

A 4 L stirred reactor was charged with 775.84 g of dodecenyl succinic anhydride (saponification number=414 mgKOH/g). The reactor was heated to 150° C. under a nitrogen sweep. 385.94 g of 1-(2-aminoethyl) piperazine (molecular weight=129.20 g/mole) was charged into the dodecenyl succinic anhydride over 30-minute period. The temperature of the mixture was increased to 160° C. and maintained for 90 minutes. The reaction was pulled under vacuum up to 20 mm Hg for 30 minutes and then cooled down to ambient temperature.

Next day, 635.01 g of octadecenyl succinic anhydride (saponification number=317 mgKOH/g) was charged into the reaction mixture at ambient temperature. The reaction mixture was heated to 215° C. under a nitrogen sweep and maintained for additional 4.5 hours. The product had the following properties: TBN=109 mg KOH/g, nitrogen=7.08 wt %.

Example 4

This Example is a composite of products obtained from the following 3 separate reactions:

1) A 4 L stirred reactor was charged with 2019.1 g of octadecenyl succinic anhydride (saponification number=317 mg KOH/g) and 460.59 g of 1-(2-aminoethyl) piperazine (molecular weight=129.20 g/mole). The reactor was heated to 215° C. under a nitrogen sweep and maintained for 2 hours. The reaction was pulled under vacuum up to 10 mm Hg for 30 minutes.
2) A 4 L stirred reactor was charged with 2083.1 g of octadecenyl succinic anhydride (saponification number=317 mgKOH/g) and 475.20 g of 1-(2-aminoethyl) piperazine (molecular weight=129.20 g/mole). The reactor was heated to 215° C. over 2-hour period while purging the vapor space with nitrogen. The reaction mixture was maintained at temperature for 2 hours. The reaction was pulled under vacuum up to 20 mm Hg for 30 minutes.
3) A 4 L stirred reactor was charged with 2087.4 g of octadecenyl succinic anhydride (saponification number=317 mgKOH/g) and 476.41 g of 1-(2-aminoethyl) piperazine (molecular weight=129.20 g/mole). The reactor was heated to 210° C. over 2-hour period while purging the vapor space with nitrogen. The reaction mixture was maintained at temperature for 2 hours. The reaction was pulled under vacuum up to 40-50 mm Hg for 30 minutes. The combined product had the following properties: TBN=84.3 mg KOH/g, nitrogen=6.28 wt %.

Seal Performance

Comparative Example A (Baseline)

A baseline lubricating oil formulation was formed containing ashless dispersants, alkaline earth metal carboxylate, sulfonate, and phenate detergents, zinc dithiophosphate, non-dispersant viscosity index improver, antioxidants, foam inhibitor, and pour point depressant.

The lubricating oil compositions of Examples 1-4 were tested for compatibility with fluorocarbon elastomer seals in a Volkswagen (VW) bench test (PV 3344) by suspending a fluorocarbon test piece in an oil-based solution. The solution was then heated to 150° C. for 168 hours. The variation in the percent volume change, points hardness change (PH), the percent tensile strength change (TS) and the percent elongation change (EL) of each sample was measured.

The test results for the compatibility test (DC AK6 Seal Friction Performance Results) are summarized below in Table 1.

TABLE 1

| | Comp. Example A (Baseline) | Example 1 | Example 4 | Example 4 | Example 4 | Example 2 | Example 3 |
|---|---|---|---|---|---|---|---|
| BN Value | 80 | 86 | 86 | 86 | 90 | 98 | 80 |
| Booster (wt %) | | 1.25 | 1.19 | 2.37 | 3.56 | 1.11 | 0.92 |
| Volume Change | 0.49 | 0.68 | 0.66 | 0.75 | 0.79 | 0.67 | 0.79 |
| Hardness | 0 | 0 | 0 | −4 | −4 | 0 | −1 |
| Tensile Strength (% change) | −39.4 | −40.5 | −36.4 | −40.3 | −37.7 | −39.6 | −44.5 |
| Elongation | −41.3 | −41.9 | −40 | −41.7 | −39.3 | −40.5 | −46.7 |
| Hardness Δ | | 0.19 | 0.17 | 0.26 | 0.3 | 0.18 | 0.3 |
| Tensile Strength Δ | | 0 | 0 | 4 | 4 | 0 | 1 |
| Elongation Δ | | 1.1 | 3 | 0.9 | 1.7 | 0.2 | 5.1 |

Comparative Example B

This sample is an automotive engine oil with a conventional amine-containing additive.

Example 5

This sample is same as Comparative Example B except the conventional amine-containing additive is replaced with the ashless additive of the present invention (reaction product of $C_{18}$ succinic anhydride and aminoethyl piperazine).

Seal compatibility results are shown in Table 2 below.

TABLE 2

| | Comparative Example B | Example 5 |
|---|---|---|
| Allison TES 439 SEALS | | |
| Average Elongation [%] Pass: ≥65 | X | 113 |
| Seal Compatibility Test (DC AK6) | | |
| Vol. Change [%]; Pass: 0 to 5 | 0.81 | 0.68 |
| Hardness [Points]; Pass: −5 to 5 | −1.0 | −3.0 |
| Tensile Strength [%]; Pass: >−50 | −49.2 | −32.7 |
| Elongation [%]; Pass: >−55 | −46.8 | −35.4 |
| Seal Compatibility Test (MTU AK6) | | |
| Vol. Change [%]; Pass: 0 to 5 | 1.3 | −0.3 |
| Hardness [Points]; Pass: −5 to 5 | 0.0 | −1.0 |
| Tensile Strength [%]; Pass: >−50 | −48.8 | −21.6 |
| Elongation [%]; Pass >−55 | −48.8 | −28.8 |

High Temperature Corrosion Bench Test (HTCBT)

The ASTM D6594 HTCBT was used to evaluate engine lubricants to determine their tendency to corrode various metals, specifically alloys of lead and copper commonly used in cam followers and bearings. Four metal specimens of copper, lead, tin and phosphor bronze were immersed in engine oil. The oil, at an elevated temperature (170° C.), was blown with air (5 l/h) for a period of time (168 h).

The copper specimen and the stressed oil were examined for corrosion and corrosion products, respectively. The concentrations of copper, lead, and tin in the new oil and stressed oil and the respective changes in metal concentrations are reported. To "pass", the concentration of lead should not exceed 120 ppm and the copper 20 ppm.

A copy of this test method can be obtained from ASTM International at 100 Barr Harbor Drive, PO Box 0700, West Conshohocken, Pa. 19428-2959.

The results for the HTCBT are summarized below in Table 3.

TABLE 3

| | Comparative Example B | Example 5 |
|---|---|---|
| HTCBT (D6594) | | |
| Copper, ppm change | 8.0 | 8.0 |
| Lead, ppm change | 46.0 | 9.0 |
| Tin, ppm change | 0.0 | 1.0 |
| Copper strip rating | 1 b | 1 b |
| PDSC (180 min) | | |
| Time to Oxidation | 87.1 | 120.4 |

Wear Performance

Lubricating oil samples were also tested for their wear performance using High Frequency Reciprocating Rig (HFRR) test.

Comparative Example C

Comparative Example C includes a baseline lubricating oil.

Example 6

Example 6 includes the baseline lubricating oil of Comparative Example C and an ashless additive of the present invention (reaction product of $C_{18}$ succinic anhydride and aminoethyl piperazine).

Example 7

Example 7 includes the lubricating oil of Comparative Example C and a conventional amine-containing additive.

Friction Modifier Performance

Figure 2:
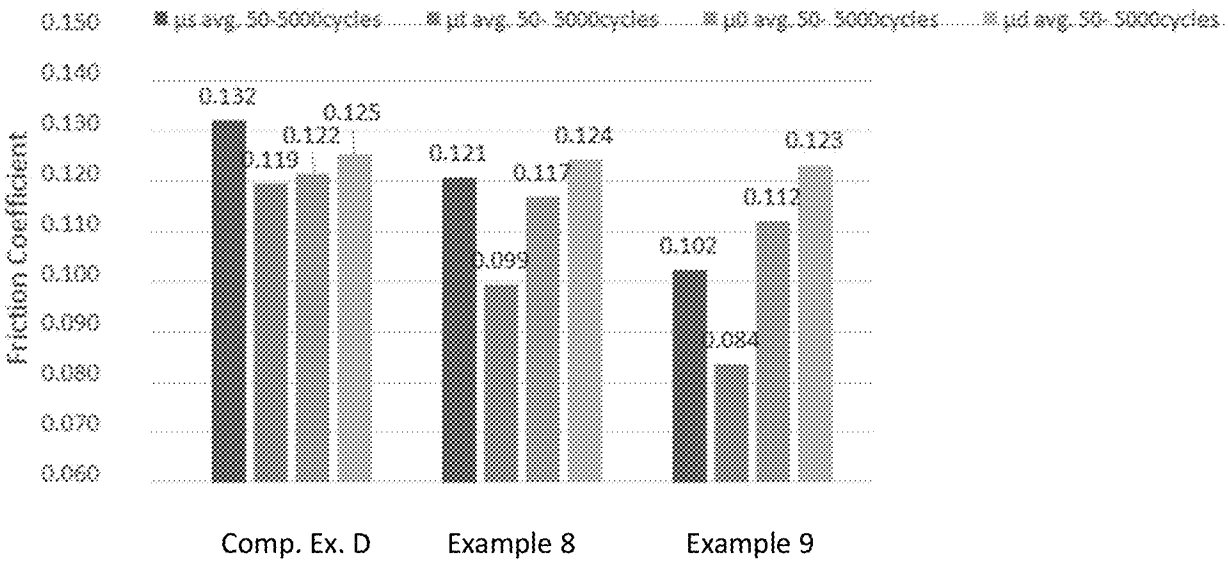
FIG. 2 shows a graph illustrating an aspect of the present invention as described in the Examples.

Samples (Comparative Example D, Examples 8 and 9) including ashless additive compositions of the present invention were tested in automatic transmission fluid. The static torque was measured using JASO SAE #2 friction test. FIG. 2 shows the SAE #2 results.

Comparative Example D

This sample includes a baseline automatic transmission fluid and the reaction product of $C_{20}$ succinic anhydride and diethylenetriamine (DETA) at 2:1 charge mole ratio. The treat rate is 1.0 wt %.

Example 8

This sample includes the baseline automatic transmission fluid used in Comparative Example D and the reaction product of $C_{18}$ succinic anhydride and aminoethyl piperazine at 1.6:1 charge mole ratio. The treat rate is 1.0 wt %.

Example 9

This sample includes the baseline automatic transmission fluid used in Comparative Example D and the reaction product of $C_{20}$ succinic anhydride and aminoethyl piperazine at 1.6:1 charge mole ratio. The treat rate is 1.19 wt %.

All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

The terms "a" and "the" as used herein are understood to encompass the plural as well as the singular.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

The foregoing description of the disclosure illustrates and describes the present disclosure. Additionally, the disclosure shows and describes only the preferred embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art. While the foregoing is directed to embodiments of the present disclosure, other and further embodiments of the disclosure may be devised without departing from the basic scope thereof, and the scope thereof is determined by the claims that follow.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein.

The embodiments described hereinabove are further intended to explain best modes known of practicing it and to enable others skilled in the art to utilize the disclosure in such, or other, embodiments and with the various modifications required by the particular applications or uses. Accordingly, the description is not intended to limit it to the form disclosed herein. Also, it is intended that the appended claims be construed to include alternative embodiments.

The invention claimed is:

1. An ashless additive composition comprising:

a tertiary amine-containing compound having the following structure:

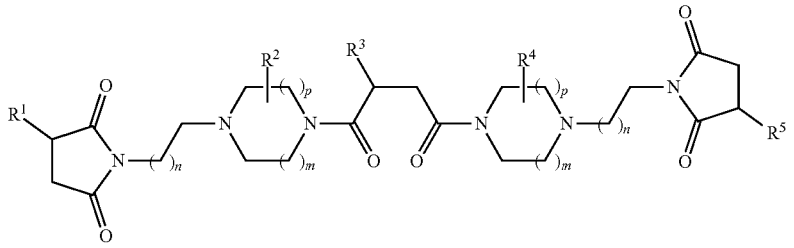

Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

wherein each $R^1$ and $R^5$ is independently a linear or branched-chain monovalent hydrocarbyl group having two to about twenty carbon atoms, wherein each $R^2$, $R^3$, and $R^4$ is independently a hydrogen, a linear or branched-chain monovalent hydrocarbyl group having one to about twenty carbon atoms wherein at least one of $R^2$, $R^3$, and $R^4$ is hydrogen, each m is independently from 0 to 4, each p is independently from 0 to 4, for each cyclic moiety m+p is from 2 to 4, and each n is independently from 1 to 6.

2. The ashless additive composition of claim 1, wherein the linear or branched-chain monovalent hydrocarbyl group is a branched $C_{12}$ to $C_{20}$ alkenyl group.

3. The ashless additive composition of claim 1, wherein the linear or branched-chain monovalent hydrocarbyl group is a branched $C_{18}$ to $C_{20}$ alkenyl group.

4. A lubricating oil composition comprising:

a major amount of a base oil; and an ashless tertiary amine-containing compound having the following structure:

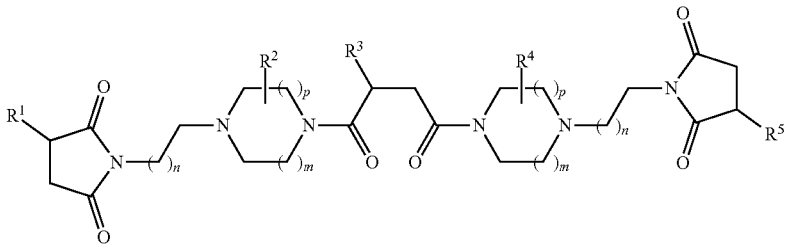

wherein each $R^1$ and $R^5$ is independently a linear or branched-chain monovalent hydrocarbyl group having two to about twenty carbon atoms, wherein each $R^2$, $R^3$, and $R^4$ is independently a hydrogen, a linear or branched-chain monovalent hydrocarbyl group having one to about twenty carbon atoms wherein at least one of $R^2$, $R^3$, and $R^4$ is hydrogen, each m is from 0 to 4, each p is from 0 to 4, for each cyclic moiety m+p is from 2 to 4, and each n is independently from 1 to 6.

5. The lubricating oil composition of claim 4, wherein the linear or branched-chain monovalent hydrocarbyl group is a branched $C_{12}$ to $C_{20}$ alkenyl group.

6. The lubricating oil composition of claim 4, wherein the linear or branched-chain monovalent hydrocarbyl group is a branched $C_{18}$ to $C_{20}$ alkenyl group.

7. The lubricating oil composition of claim 4, wherein the tertiary amine-containing compound is present in about 0.1 to 2 wt % by weight of the lubricating oil composition.

8. The lubricating oil composition of claim 4, wherein the lubricating oil composition is a hydraulic fluid, a slide way lubricant, automatic transmission fluid, continuously variable transmission fluid, battery electric vehicle, hybrid electric vehicle transmission fluid, or gear oil.

9. The lubricating oil composition of claim 4, further comprising: a friction modifier, ashless anti-wear additive, antioxidant, metal deactivator, seal swell additive, foam inhibitor, or viscosity modifier.

10. An ashless additive composition comprising diamide product of a reaction comprising:

a hydrocarbyl-substituted succinic anhydride represented by the following structure:

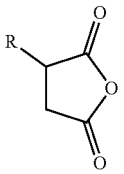

wherein R is a linear or branched-chain monovalent hydrocarbyl group having two to about twenty carbon atoms; and a cyclic polyamine represented by the following structure:

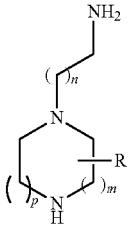

wherein R is a linear or branched-chain monovalent hydrocarbyl group having two to about twenty carbon atoms, m is from 0 to 4, p is from 0 to 4, m+p is from 2 to 4, and n is from 1 to 6; and wherein the hydrocarbyl-substituted succinic anhydride to cyclic polyamine ratio is about 1.5:1 to about 1.6:1.

11. The ashless additive composition of claim 10, wherein the cyclic polyamine is aminoethyl piperazine, aminopropyl piperazine, aminobutyl piperazine, aminoethyl diazepane, or aminoethyl diazocane.

12. A method for modifying friction in an engine, the method comprising lubricating said engine with a lubricating oil composition comprising:

a major amount of base oil of lubricating viscosity; and an ashless additive composition having the following structure:

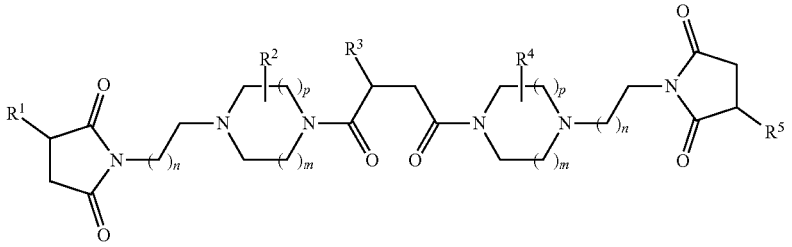

wherein each $R^1$ and $R^5$ is independently a linear or branched-chain monovalent hydrocarbyl group having two to about twenty carbon atoms, wherein each $R^2$, $R^3$, and $R^4$ is independently a hydrogen, a linear or branched-chain monovalent hydrocarbyl group having one to about twenty carbon atoms wherein at least one of $R^2$, $R^3$, and $R^4$ is hydrogen, each m is independently from 0 to 4, each p is independently from 0 to 4, for each cyclic moiety m+p is from 2 to 4, and each n is independently from 1 to 6.

13. The method of claim 12, wherein the linear or branched-chain monovalent hydrocarbyl group is a branched $C_{12}$ to $C_{20}$ alkenyl group.

14. The method of claim 12, wherein the linear or branched-chain monovalent hydrocarbyl group is a branched $C_{18}$ to $C_{20}$ alkenyl group.

15. A method of boosting total base number in a lubricating oil, the method comprising blending base oil and an ashless additive composition having the following structure:

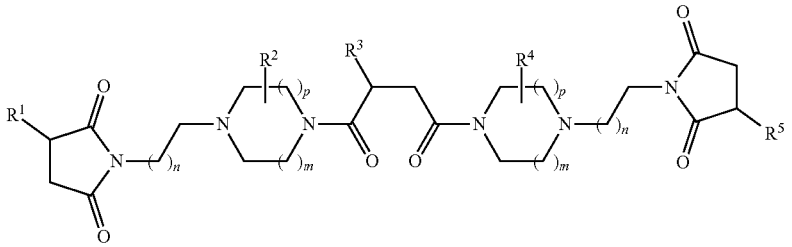

wherein each $R^1$ and $R^5$ is independently a linear or branched-chain monovalent hydrocarbyl group having two to about twenty carbon atoms, wherein each $R^2$, $R^3$, and $R^4$ is independently a hydrogen, a linear or branched-chain monovalent hydrocarbyl group having one to about twenty carbon atoms wherein at least one of $R^2$, $R^3$, and $R^4$ is hydrogen, each m is independently from 0 to 4, each p is independently from 0 to 4, for each cyclic moiety m+p is from 2 to 4, and each n is independently from 1 to 6.

* * * * *